US007438293B2

(12) United States Patent
Sklansky et al.

(10) Patent No.: US 7,438,293 B2
(45) Date of Patent: Oct. 21, 2008

(54) FACILITATED GAMING SYSTEM AND METHOD WITH EQUALIZING CRITERIA FOR FACILITATOR

(75) Inventors: David Bruce Sklansky, Henderson, NV (US); Bradley Berman, Minnetonka, MN (US)

(73) Assignee: Sklansky Games, LLC, Minnetonka, MN (US)

( * ) Notice: Subject to any disclaimer, the term of this patent is extended or adjusted under 35 U.S.C. 154(b) by 12 days.

(21) Appl. No.: 11/135,804

(22) Filed: May 24, 2005

(65) Prior Publication Data

US 2005/0269782 A1 Dec. 8, 2005

Related U.S. Application Data

(60) Provisional application No. 60/574,275, filed on May 25, 2004, provisional application No. 60/574,387, filed on May 25, 2004.

(51) Int. Cl.
*A63F 1/00* (2006.01)

(52) U.S. Cl. ..... 273/274; 273/292

(58) Field of Classification Search ..... 273/274, 273/292; 463/12, 13

See application file for complete search history.

(56) References Cited

U.S. PATENT DOCUMENTS

| | | | | |
|---|---|---|---|---|
| 4,861,041 | A | 8/1989 | Jones et al. | |
| 4,948,134 | A | 8/1990 | Suttle et al. | |
| 5,265,882 | A | 11/1993 | Malek | |
| 5,328,189 | A | 7/1994 | Malek | |
| 5,356,140 | A | 10/1994 | Dabrowski et al. | |
| 5,377,993 | A | 1/1995 | Josephs | |
| 5,382,025 | A | 1/1995 | Sklansky et al. | |
| 5,486,005 | A | 1/1996 | Neal | |
| 5,489,101 | A | 2/1996 | Moody | |
| 5,496,038 | A | 3/1996 | Kangsanaraks | |
| 5,531,448 | A | 7/1996 | Moody | |
| 5,573,249 | A | 11/1996 | Johnson | |
| 5,577,731 | A | 11/1996 | Jones | |
| 5,639,092 | A | 6/1997 | Macaisa | |
| 5,645,281 | A * | 7/1997 | Hesse et al. | 273/292 |
| 5,657,993 | A | 8/1997 | Merlino et al. | |
| 5,718,430 | A | 2/1998 | Aramapakul et al. | |
| 5,725,215 | A * | 3/1998 | Hesse | 273/292 |
| 5,732,950 | A | 3/1998 | Moody | |
| 5,795,225 | A | 8/1998 | Jones et al. | |

(Continued)

OTHER PUBLICATIONS

2003, Casino Poker Guide, "Online Poker Rules", 2003.

*Primary Examiner*—William M Pierce
(74) *Attorney, Agent, or Firm*—Hollingsworth & Funk, LLC

(57) ABSTRACT

Systems and methods for playing a dealer-facilitated card game including use of a dealer-equalization criteria and a dealer-favored bias criteria. The game involves dealing a starting hand to at least one player and to the dealer, wherein each starting hand includes one or more cards representing a potential portion of a resulting hand. A bet is placed by the player, and the bet is called by the dealer. The respective ranks of each hand are determined and one of the resulting hands is identified as the winning hand. Distribution of the betting pool is assessed based on at least the winning hand and dealer-favored bias criteria. A player puts up an initial commission that would be taken whether or not the player makes a second bet and whether or not the player won.

16 Claims, 11 Drawing Sheets

U.S. PATENT DOCUMENTS 5,799,945 A 9/1998 Boylan et al.
5,810,354 A 9/1998 Banyan
5,823,873 A 10/1998 Moody
5,839,732 A 11/1998 Guidi
5,845,906 A 12/1998 Wirth
5,851,011 A 12/1998 Lott
5,868,392 A 2/1999 Kraft
5,901,958 A 5/1999 Andrews
5,911,419 A * 6/1999 Delaney et al. ..... 273/292
5,913,726 A 6/1999 Jones et al.
5,944,314 A 8/1999 Stavinsky
6,068,552 A * 5/2000 Walker et al. ..... 463/21
6,102,402 A * 8/2000 Scott et al. ..... 273/292
6,132,311 A 10/2000 Williams
6,206,373 B1 * 3/2001 Garrod ..... 273/292
6,206,374 B1 3/2001 Jones
6,234,895 B1 5/2001 Jones et al.
6,375,189 B1 4/2002 Jones
6,402,150 B1 6/2002 Jones
6,435,500 B2 8/2002 Gumina
6,435,506 B1 8/2002 Piccoli
6,467,771 B1 10/2002 deKeller
6,481,717 B1 11/2002 Richardelle
6,503,145 B1 1/2003 Webb
6,511,068 B1 1/2003 Skalansky et al.
6,561,897 B1 5/2003 Bourbour et al.
6,637,747 B1 * 10/2003 Garrod ..... 273/292
6,644,666 B1 * 11/2003 Tamura et al. ..... 273/292
6,712,693 B1 * 3/2004 Hettinger ..... 463/20
6,719,291 B1 4/2004 deKeller
6,719,292 B2 * 4/2004 Lo ..... 273/292
6,719,631 B1 * 4/2004 Tulley et al. ..... 463/17
6,752,395 B2 6/2004 Jones et al.
6,830,247 B2 * 12/2004 Lo ..... 273/292
6,866,267 B1 * 3/2005 Hesse ..... 273/292
6,959,928 B2 * 11/2005 Schultz ..... 273/292
7,044,468 B2 5/2006 Sklansky et al.
7,121,550 B1 * 10/2006 Lo ..... 273/292
7,322,578 B2 * 1/2008 Swartz et al. ..... 273/292
2001/0052671 A1 12/2001 Stern
2001/0054796 A1 12/2001 Lo
2002/0008356 A1 1/2002 deKeller
2002/0043765 A1 4/2002 Moody
2003/0027614 A1 2/2003 Webb
2003/0162424 A1 8/2003 Berman
2004/0041346 A1 3/2004 Snow
2005/0082755 A1 4/2005 Snow
2005/0104293 A1 5/2005 Webb
2005/0107148 A1 5/2005 Webb
2005/0167924 A1 8/2005 Sklanksy et al.
2006/0281536 A1 * 12/2006 Wright ..... 463/25
2007/0235939 A1 * 10/2007 Ko ..... 273/292

* cited by examiner

| 600 PLAYER STARTING HAND | 602 PLAYER ACTION | 604 DEALER STARTING HAND | 606 DEALER ACTION | 608 COMMUNITY CARDS | 610 RESULT |
|---|---|---|---|---|---|
| 7 2 | FOLD | X | X | X | PLAYER LOSES $1 |
| J 2 | BET 5 | 10 6 | CALL | J 8 5 3 2 | PLAYER WINS $6 |
| 5 5 | BET 5 | 8 8 | CALL | 8 8 5 5 2 | PLAYER LOSES $6 |

612 616 618

*FIG. 6*

FACILITATED GAMING SYSTEM AND METHOD WITH EQUALIZING CRITERIA FOR FACILITATOR

CROSS-REFERENCE TO RELATED APPLICATIONS

This application claims the benefit of U.S. Provisional Application Nos. 60/574,275 and 60/574,387, both filed on May 25, 2004, to which priority is claimed pursuant to 35 U.S.C. §119(e) and which are incorporated herein by reference in their entireties. This application is also related to commonly assigned U.S. patent application Ser. No. 10/686,020, filed Oct. 15, 2003, and U.S. patent application Ser. No. 11/069,928, filed Mar. 1, 2005, the contents of which are incorporated herein by reference in their entireties.

FIELD OF THE INVENTION

This invention relates in general to methods and systems for playing games that are facilitated at a control point, such as a dealer in a card game or a machine programmed to control the progress of a game. More particularly, this invention relates to an apparatus and method for facilitating play of a game in which its facilitator operates with game criteria that, relative to at least one of the other players, provides a degree of equalization to the facilitator's chances of winning.

BACKGROUND OF THE INVENTION

Many games are facilitated at a control point to control the progress of a game and/or to provide a biased opponent against which one or more players compete. Two examples of such facilitated games are card games, such as poker, and slot-machine games. In the game of poker, a dealer controls the deck and, in many situations, enforces the rules of the game. In slot-machine games, the mechanics of the machine are programmed to control the rules of the game as well as the odds of the other player(s) winning. The popularity of these types of games, whether in one's home or in a casino-gambling environment, continues to increase. Whether played in a manually-controlled environment or in an automated environment such as a computer game, society's fascination with such facilitated games and gaming activity is unfaltering.

In traditional games of this type, players gather to compete against the facilitator and sometimes against each other as well. In a dealer-facilitated poker game, for instance, players compete by waging bets that their poker hand will have a higher poker rank than the respective ranks of the dealer's and other players' hands. The highest poker rank in each played hand is the winner of the hand, and if bets were made, the winner collects the bets made by the losing players for that hand.

Other table games are similar in that players place their bets, and the player with the winning hand wins the pot. One such poker game is known as "Hold'em," where each player at the table is dealt, face-down, a hand of two cards. After a betting round, the dealer turns face-up three communal cards known as the "flop." Bets are made, and additional communal cards are turned face-up, ultimately exposing the entire communal card hand known as the "board." Thus, each of the players uses his/her two-card face-up hand in connection with the board to determine the resulting poker rank, and the highest poker rank identifies the winner of the hand. The winner collects the pot.

While Hold'em and other facilitated games continue to be extremely popular, fascination and continued interest can be difficult without changing some aspects of the game. Implementing such changes successfully can be difficult, however. Too large a degree of change can intimidate players due to seemingly-excessive efforts to learn the import of the changes. Moreover, in the wagering environments, too much change risk the appearance of being implemented to unfairly favor the facilitator; and, if changes unfairly disfavor the facilitator, the game would not be implemented by otherwise interested facilitators. It would therefore be desirable to provide such facilitated games with different excitement and more intricate and interesting betting strategies, while avoiding the above-discussed and other problems.

SUMMARY OF THE INVENTION

The present invention is directed to dealer-facilitated gaming methods and systems that address the above-discussed and other issues and that provide excitement and intricate and interesting betting strategies.

In one embodiment, a method for playing a dealer-facilitated game includes use of a dealer-favored bias criteria. The game involves dealing a starting hand to at least one player and to the dealer, wherein each starting hand includes one or more cards representing a potential portion of a resulting hand. A bet is placed by the player, and the bet is called by the dealer. The respective ranks of each hand are determined and one of the resulting hands is identified as the winning hand. Distribution of the betting pool is then assessed based on at least the winning hand and the dealer-favored bias criteria.

In another embodiment, a method for playing a dealer-facilitated game includes use of a dealer-favored bias criteria. The game involves dealing a starting set of valued game-pieces to at least one player and to the dealer, wherein each starting set of valued game-pieces includes one or more valued game-pieces representing a potential portion of a resulting set of valued game-pieces. A bet is placed by the player, and the bet is called by the dealer. The respective ranks of each set of valued game-pieces are determined and one of the resulting set of valued game-pieces is identified as the winning set of valued game-pieces. Distribution of the betting pool is then assessed based on at least the winning set of valued game-pieces and dealer-favored bias criteria.

In another embodiment, the present invention is directed to an apparatus and method for participating in a card game utilizing starting hands (and in some implementations community hands also), and implementing equalization and bias criteria for the dealer where these criteria at least in part dictates the manner in which the game proceeds.

In another embodiment, a method for playing a dealer-facilitated card game includes use of a dealer-equalization criteria and a dealer-favored bias criteria. The game involves dealing a starting hand to at least one player and to the dealer, wherein each starting hand includes one or more cards representing a potential portion of a resulting hand. A bet is placed by the player, and the bet is called by the dealer. The respective ranks of each hand are determined and one of the resulting hands is identified as the winning hand. Distribution of the betting pool is then assessed based on at least the winning hand and the dealer-favored bias criteria.

In accordance with other aspects, the invention is implemented as a live table version or as electronic embodiments.

These and various other advantages and features which characterize the invention are pointed out with particularity in the claims annexed hereto and form a part hereof. However, for a better understanding of the invention, its advantages, and the objects obtained by its use, reference should be made to the drawings which form a further part hereof, and to accompanying descriptive matter, in which there are illustrated and described various examples in accordance with the invention.

BRIEF DESCRIPTION OF THE DRAWINGS

The invention is described in connection with the embodiments illustrated in the following diagrams.

FIG. 6 is a table illustrating a number of exemplary game plays and corresponding results in accordance with embodiments of the present invention;

DETAILED DESCRIPTION OF THE ILLUSTRATED EMBODIMENTS

Figure 1:
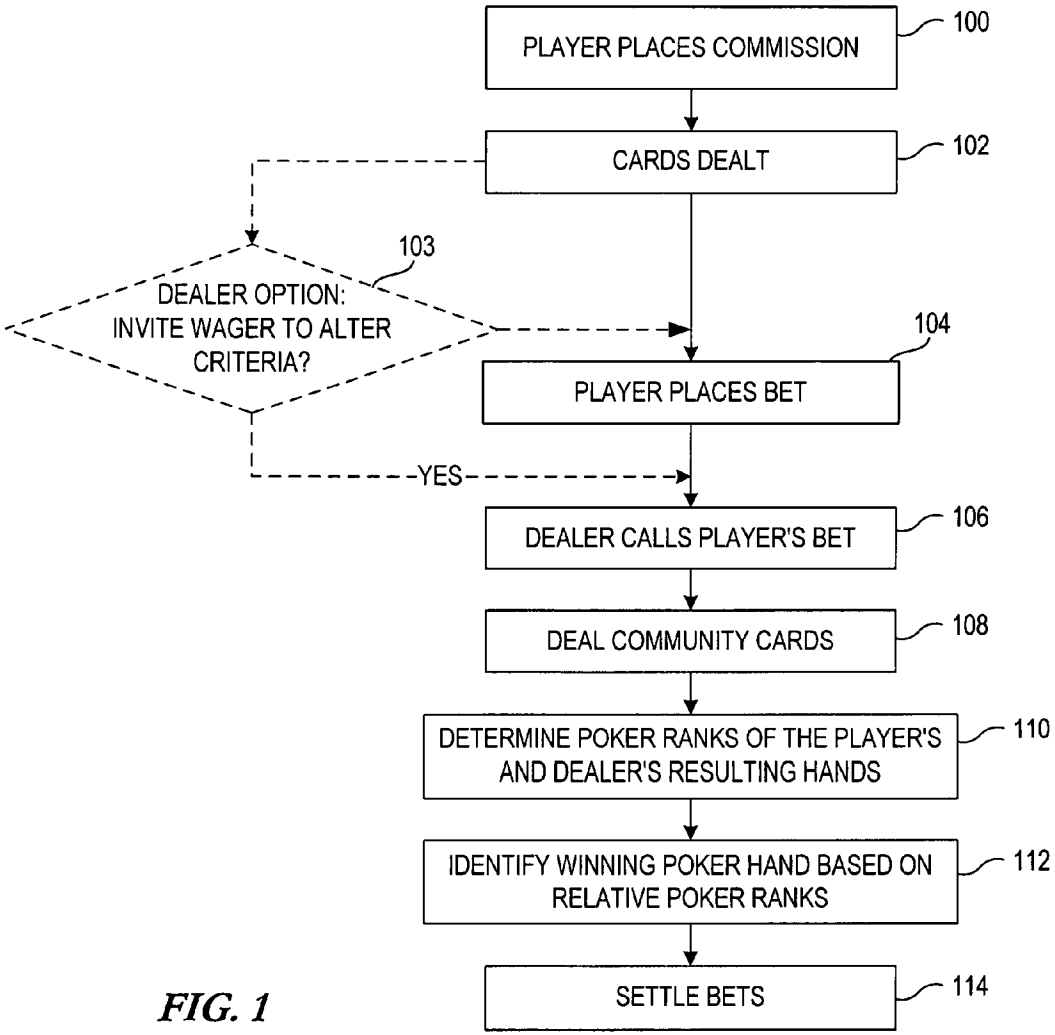
FIG. 1 is a flow diagram illustrating one embodiment of a method in accordance with the present invention.

In the following description of various exemplary embodiments, reference is made to the accompanying drawings, which form a part hereof, and in which is shown by way of illustration various embodiments in which the invention may be practiced. It is to be understood that other embodiments may be utilized, as structural and operational changes may be made without departing from the scope of the present invention.

Generally, the present invention provides a card game and a manner of providing such a card game, with the understanding that a "card game" involves the distribution of valued-player pieces with each player's use of these pieces valuated to assess points and, in most instances, a winner. The invention provides a manner for facilitating play of a card game utilizing dealer-equalization criteria as well as dealer-biased criteria that impact the manner in which the game proceeds. Using the dealer-equalization criteria, the player is aware that his chances of winning are about even with the dealer's chance of winning.

The dealer-biased component provides the dealer with sufficient incentive to facilitate the game. In a wagering context, this dealer advantage provides the practical necessity that the wager-providing facilitator would require before inviting player's to the game. Because the dealer automatically calls in response to the player's bet, it is mathematically necessary that the player does not always come out even or better on the wager. Otherwise, when the player bets his hand, he could simply bet every time and, at worst, realize an even game. In this context, one aspect of the present invention is directed to ensuring that, on average, the player does not always win even or better money when he bets and wins. In certain embodiments, the present invention provides this mechanism not only as a method to give the facilitator an edge, but also probably to allow the facilitator to pay much better than even money to the player on certain hands.

In accordance with the present invention, implementations vary depending on various factors such as the desired complexity of the game and the extent to which the game rules would define a community hand. In a particular implementation, the invention is implemented in a poker game that includes an initial bet, a starting hand and at least one community hand. The starting hand is dealt to the player(s) and to the dealer. The player may fold based on the state of the player's starting hand, or may place a bet. The dealer calls the players' bets, and deals a community hand. The community hand may be dealt all at once, or may include interim betting in accordance with the invention. Using their respective starting hands and the community hand, each of the players and the dealer arrives at a resulting hand. If a player's resulting hand beats the dealer's resulting hand based on poker rank, that player wins. For example, the player may receive net winnings equal to the dealer's call bets made in response to the player's ante and post-ante bets, such as forfeiting (to effect a bias criteria favoring the dealer) some or all of the player's ante but taking the called bet (i.e. the post-ante bet).

One such card game that includes a starting hand and a communal hand is "All In Hold'em," as described in the above-mentioned patent documents previously incorporated by reference (U.S. Pat. No. 7,044,468 and U.S. Pat. Publication 2005/0167924). In this game, each player at the table is dealt, face-down, a hand of two cards. The players place their bets before and/or after the dealer deals the first three cards, known as the "flop," of the community hand. Bets are made, and cards of the community hand are dealt, until the entire community hand is dealt. The exposed cards of the community hand are typically referred to as the "board." Thus, each of the players uses his/her two-card face-up hand in connection with the board to determine the resulting poker rank, and the highest poker rank identifies the winner of the round. This implementation of the present invention deviates somewhat from the All In Hold'em embodiments.

As in All In Hold 'em, each player and the dealer receives two cards to start a "head up" Hold'em hand. The dealer's card may be face down, or one or both of them are exposed. Each player may bet or fold and in some embodiments, the player's bet may be allowed to vary within a range. By folding, the player elects to give up some initial amount as in All In Hold'em. Unlike that game, however, the player's chances of winning in connection with the present invention are more apparent as well as more even because if the player bets, the dealer calls. With all other criteria being the same, this automatic dealer-call requirement provides an important equalization and the associated anticipation that the player's chance of winning a given hand is on average about fifty percent.

In one embodiment of the present invention, the game begins with the player putting up an "initial commission" that (as game rules may require) may be taken regardless of the game's outcome. The next wager put up by the player would then be a certain multiple of the commission or, alternatively, an amount up to that multiple. A set of community cards are then used selectively by each player and the dealer, along with the initially dealt cards, to complete each hand. The best hand wins. However, in a particular embodiment the initial commission would be taken whether or not the player made that second bet and whether or not the player won.

Consider an example in which after the dealer receives the player's initial commission in the amount of ten dollars, the dealer deals the player two fives and himself two cards one of which is a four that is exposed. The player is allowed to bet up to fifty dollars more and bets the full amount ($60 total). The dealer takes the ten dollars, and then exposes a second four. The community (or board) cards are 2,4,4,5,5. The dealer pays the player because the dealer's resultant hand would be 4,4,4,4,5, whereas the player's resultant hand would be 5,5, 5,5,4. Assuming there is no bonus, this would be a payment in the amount of $50; the dealer, however, has paid out a net amount of only $40. In a typical version in which a bonus amount can be won, there would be a greater than even money payoff because the player made four of a kind. In some versions there would be an extremely high payoff because the player beat four of a kind and, in yet other versions, there would also be a "bad beat" jackpot offered when the player loses with four of a kind or better. Had the board come down 2,4,6,8,9. The dealer's resultant hand would be 4,4,4,8,9 (beating 5,5,6,8,9), and the dealer (or house) would win $60. In the example where the community cards are 2,4,4,5,5, had the player not played his two fives the dealer (or house) would win $10.

In another embodiment of the present invention, the initial commission is paid only if the player folds, or plays and loses. If the player makes this second bet and wins, the bet would be refunded. In that case, the second bet is defined to be of a smaller amount than in the previously-discussed embodiment if everything else was equal. If the second bet were not defined to be of a smaller amount, the dealer's advantage would diminish (assuming, e.g., the bonus pays remain the same). With an initial bet of $10 and a second bet of $50, the dealer would once again win $10 if the player folded, win $60 if the player bet and lost, but would now lose $50 rather than $40 if the player bet and won. This second embodiment has the disadvantage of being slightly more complex and forcing the dealer to pay smaller jackpots for the same bet multiple. An advantage is that players may prefer a game where they can save their commission with a win. Another advantage might be that the player's decision is more complex in the second embodiment since the player is gaining a bit more when he successfully bets than he does in the first embodiment.

As will become more evident in the ensuing description, the present invention may be played in a live table version, or in an electronic environment (e.g., computer-implemented video game/machine, casino kiosk, etc.). Electronic embodiments of the invention generally involve a single game participant with no other players associated with the game, however other players may be participating in the game via remote gaming machines. Further, electronic embodiments may involve a computerized dealer or "virtual dealer." However, the description herein relating to how the game may be played is applicable to both live table games and electronic embodiments.

It should be recognized that, for purposes of the present description, the community hand may be referred to as the community hand, community cards, communal cards/hand, the board, etc. It should also be recognized that reference may be made to a dealer calling a bet, matching a bet, placing a bet, etc. In some embodiments, a dealer may physically match a player's bet using money, a chip(s), selecting an appropriate bet designator, or the like. However, in other embodiments such as a casino environment, reference to a dealer placing, matching, or calling a bet does not involve a physical bet being presented by the dealer. In such embodiments, the dealer "in essence" places a matching ante or other bet when the dealer calls such bets, but typically does not physically present the house/dealer bet amount until, and unless, the player wins the hand as it pertains to that player and the dealer. In other words, a live table embodiment of the invention will generally not involve (although it may) any physical presentation of bets by the dealer, but rather the dealer simply calls the players' bets. In an electronic embodiment, a visual representation of the dealer's "bets" may, or may not, be displayed on the screen. In any event, as used in connection with the present invention, reference to a dealer placing, matching, calling, or otherwise making an ante and/or other bet is intended to include both situations where the dealer does not physically present the ante/bet (e.g., tantamount to the dealer/house promise to pay) and situations where the dealer does in fact physically present the ante/bet.

FIG. 1 is a flow diagram illustrating one embodiment of the present invention. In the illustrated embodiment, the player places a commission 100 to begin play. The game may be played with a dealer and one player, or with multiple players. In one embodiment, the player's resulting hands are not played against one another, but rather each of the player's resulting hands is played against the dealer's resulting hand.

In one embodiment such as a live table version of the game, one or more players puts up the commission 100 that will likely (if not automatically) be part of the player's losses during the game. Whether the initial commission 100 is lost to the dealer automatically depends on the game rules and, in some instances, also depends on a selection and wager amount provided by the players. The starting hands are dealt 102 face down. Having been dealt a starting hand, each of the players may place a bet, as depicted at 104. In some embodiments, the player may fold upon seeing his/her respective starting hand, in which case the player would lose the initial commission, as well as any additional ante or other initial bet placed. Assuming the player does not fold, the player's bet 104 forms part of the betting pool (or pot).

At this stage (as depicted at 103 or, alternatively, another point in the game) certain implementations of the present invention provide an option for the dealer to invite bias-modifying wagers from the players. In one embodiment, bias-modifying wagers are invited before the first hand is dealt to limit the number of community cards accessible to the dealer; with such a wager the dealer can accept, decline or accept with a limit on the amount the player can subsequently bet. For example, the board may later be 2,4,4,5,5, with the player holding two fives, and with the dealer holding a hidden four and an exposed four. The player pays a certain amount (say $20) to limit the dealer to playing only the three highest valued cards; in this case 4,5,5. The player's resultant hand includes four fives, and dealer's resultant hand includes two four and two fives. With this outcome and with a winning hand based on a predetermined poker ranking, the player wins but with the modified dealer-bias criteria offsetting the player's winnings by the wagered amount, $20. Any particular poker rank may be selected, and may be based on the desired return percentage to the house.

In various embodiments, the dealer-biased criteria take on different forms. For example, the dealer-biased criteria type can be implementing using only the above type of bias-modifying wagers and not using the initial commission 100. In another version, only the initial commission 100 is used. In yet other versions, both the above type of bias-modifying wagers and the initial commission 100 are used. It will be appreciated that the bias-modifying wagers and the initial commission 100, as may be used in each version, would typically be set to provide the appropriate incentives for both the player and the dealer, with the latter being favored on average.

In any event, after the player's bet(s), the dealer calls 106 the player's bet(s) or otherwise places a bet in response to the player's bet. In one embodiment, the dealer calls each of the players' bets, such that the dealer bets against each of the players with the same wager amount as was made by that player.

The dealer then calls the bets 106 and deals the community cards, as depicted at 108. Using their respective starting hand in connection with the board, each player as well as the dealer derives the best poker hand possible (i.e., having the highest poker rank), as shown at block 110. The winning poker hand is identified 112, based on the relative poker ranks of each of the players' resulting hands with respect to the dealer's resulting hand, and the bets are settled 114. For example, if a first player has a resulting hand having a higher poker rank than the dealer's resulting hand, that first player is a winner, and will receive the bet amount called by the dealer. If a second player has a resulting hand having a lower poker rank than the dealer's resulting hand, that second player does not win, and forfeits his/her wagered amount to the dealer/house.

Figure 2:
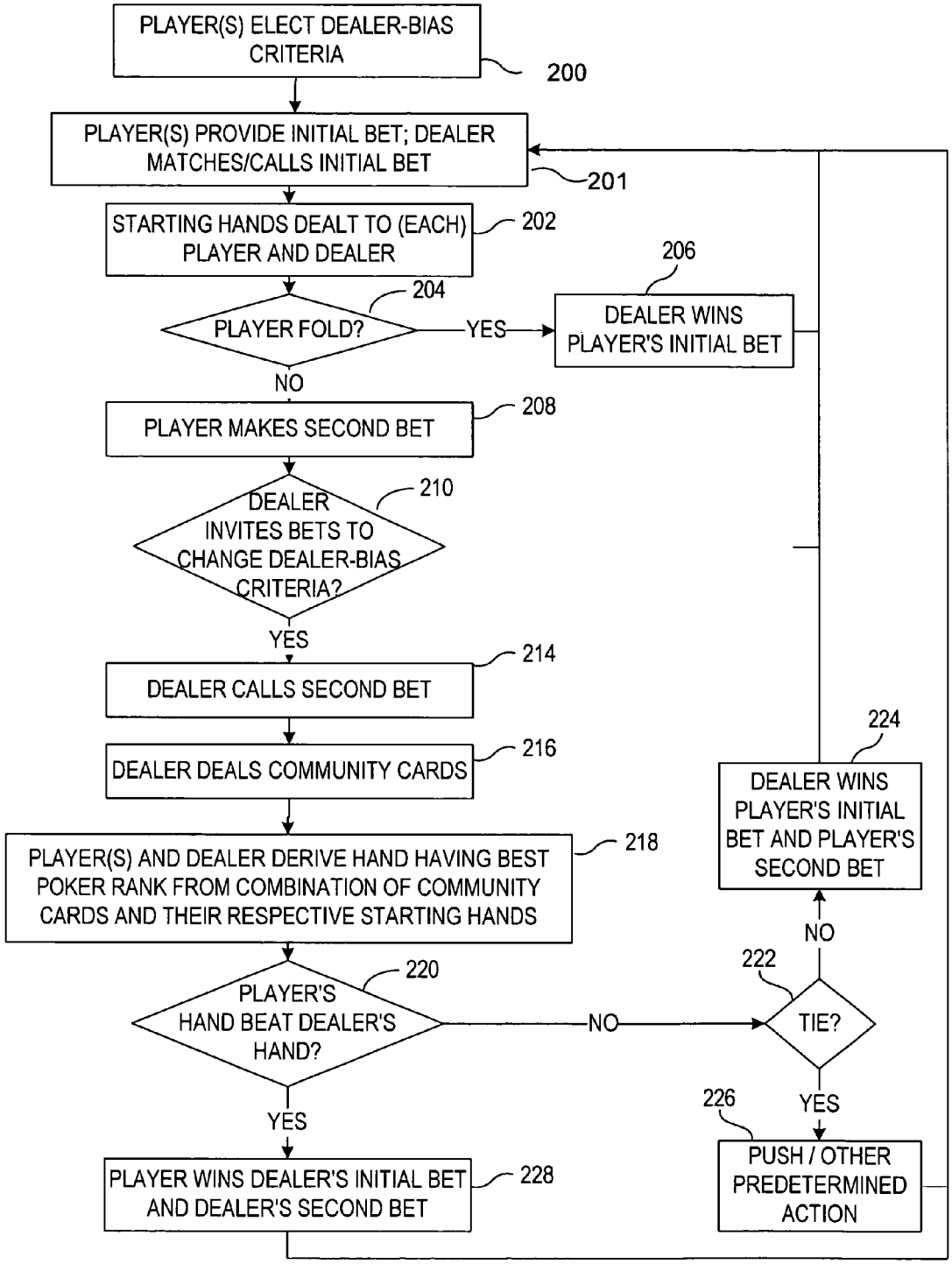
FIG. 2 illustrates another embodiment of a manner of participating in a card game in accordance with the present invention.

FIG. 2 illustrates another embodiment of a manner of participating in a card game in accordance with the present invention. The embodiment of FIG. 2 begins at 200 where the dealer can invite (as an option) each player to select the dealer bias criteria. This selection can be, for example, from a list of possible changes to the game rules so as to alter the game. In some versions, the dealer informs the player(s) of the initial commission required for each of the changes. In other versions, the dealer informs the player(s) of the initial commission and then each player spins a wheel and the wheel randomly stops on the rule change. In yet another version, the dealer can decline any such proposed rule change and the game proceeds using a default set of games rules that, depending on the version, may or may not require an initial commission at this stage.

As depicted at stage 201 of FIG. 2, the player(s) then provides an initial bet or "ante," and the dealer calls or otherwise matches the ante as shown at block 201. Starting hands are dealt 202 to the player(s) and to the dealer. The player may fold, and if the player folds as determined at decision block 204, the dealer/house wins 206 the player's commission. If the player does not fold, the player makes a second bet (relative to the commission), as shown at block 208.

At stage 210, the dealer can then invite the player(s), for one or more specified amounts, to modify the dealer-bias criteria, as discussed above. Once these bets are received, the dealer calls 214 the player's bet (or otherwise makes a second bet in response to the player's bet), and deals 216 all or a portion of the community hand. For example, in one embodiment, all cards of the community hand may be dealt, such as all five cards in a five-card community hand. Alternatively, interim bets may be allowed. For example, for a five-card community hand, three cards of the community hand may be dealt or otherwise exposed, and another bet may be allowed by the players. Another card(s) of the community hand may then be dealt or otherwise exposed, and more interim bets allowed, and so forth until the entire community hand has been dealt/exposed. In such an embodiment, the dealer may look at the dealer's starting hand without exposing it to the players, until all bets have been placed at which time the dealer's starting hand may be exposed. In still other embodiments, the community hand may be dealt in a non-consecutive manner, without additional bets. For example, the first three cards of the community hand may be dealt to the board face up, then a card is burned or otherwise discarded, then another card dealt to the board, another card burned, and a final card of a five-card community hand dealt. Dealing in this fashion may present additional anticipation for the players. It should be noted, however, that the present invention is not limited to any particular manner of dealing or otherwise presenting the community cards, nor is the invention limited in the number of community cards that may be used for the community hand.

The player and dealer each derive 218 a hand having the best poker rank from a combination of the community hand and their respective starting hands. For example, where the starting hands are two-card starting hands and the community hand is a five-card community hand, the player and the dealer will derive the best five-card poker hand based on the seven cards comprising the communal hand and their respective two-card starting hands. If the player's hand does not beat the dealer's hand as determined at decision block 220, the dealer/house has either won the hand or a tie has occurred. If it is not a tie as determined at decision block 222, the dealer/house wins 224 the player's commission, ante, and second bet(s). If there is a tie, house rules or other predetermined rules will dictate the action, as shown at block 226. For example, a tie may result in a "push" such that no money (beyond any initial commission) is exchanged. In other embodiments, a tie may result in the player losing to the house; i.e., the house rules may require the player's hand to outright beat the dealer's hand in order to win. In yet another embodiment, the predetermined action/rules may allow the player to win when a tie occurs. Again, the present invention is not limited to any particular rules for ties, as any desired rules may be provided for ties in accordance with the present invention. If the player's hand does beat the dealer's hand as determined at decision block 220, the player wins 228 the dealer's matching ante and second bet(s).

Figure 3:
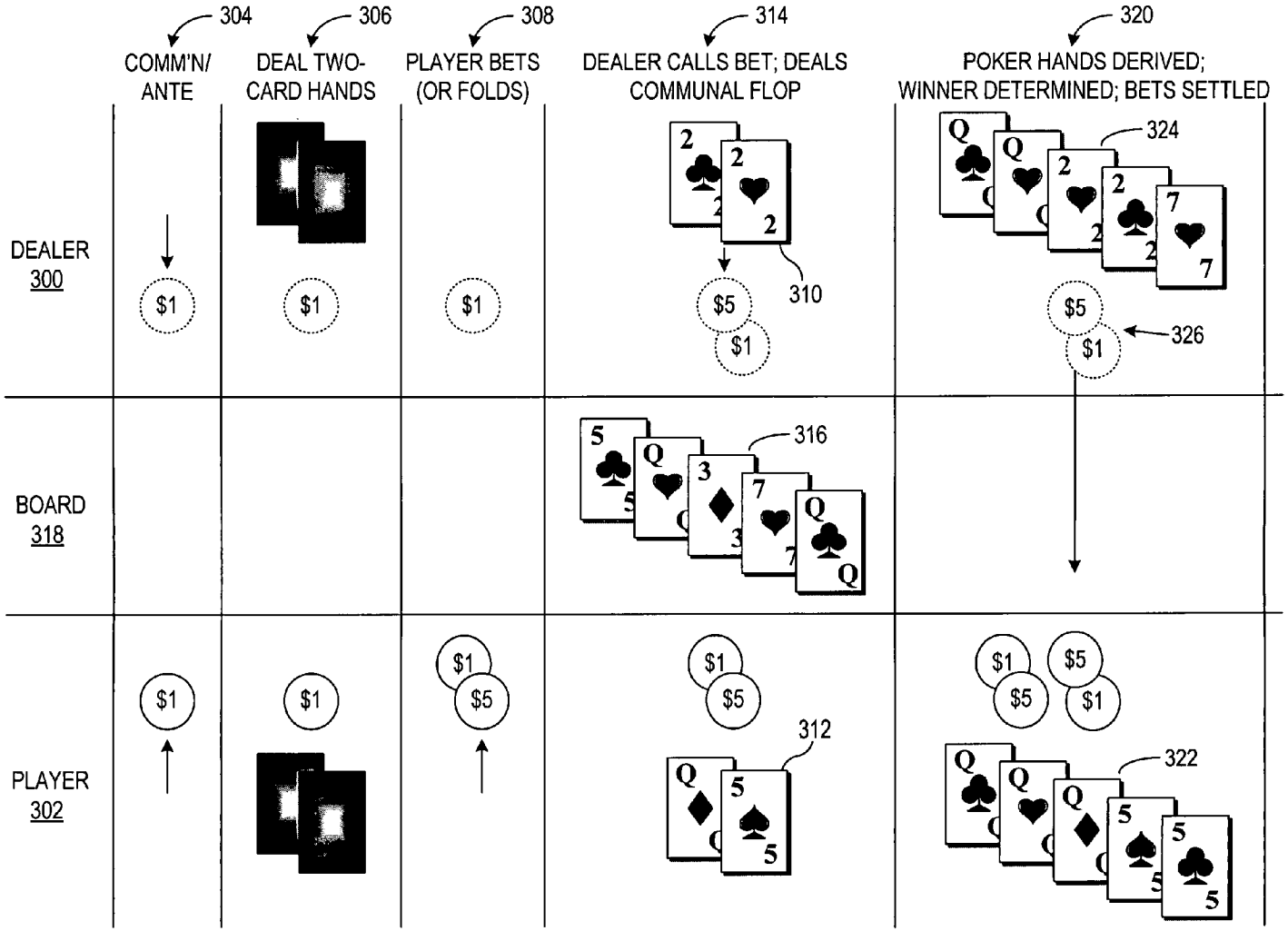
FIG. 3 is a diagram illustrating a representative hand in another card game in accordance with the present invention.

FIG. 3 is a diagram illustrating a representative hand in a card game that is also in accordance with the present invention. In the illustrated example, the dealer 300 and player 302 each submit an ante 304. Again, it should be recognized that the dealer 300, unlike both the initial commission and the ante provided by the player 302, does not have to "physically" present an ante, but rather may simply call the player's ante such that the dealer/house is expected to pay the ante in the event that the dealer loses to the player. Because the dealer's ante and other bets do not require physical presentation of chips, money, or other actual bets, the ante and bet amounts for the dealer 300 shown in FIG. 3 are shown by dashed lines.

In the illustrated example, the ante 304 is shown as $1, although other ante amounts could be set. A two-card hand 306 is dealt to both the dealer 300 and the player 302. In one embodiment, the two-card hand 306 is dealt face down to the dealer and to the player. In another embodiment, the two-card hand 306 may be dealt face up for the player 302. For example, in an electronic embodiment, the player's two-card hand 306 would generally be "dealt" (i.e., electronically displayed) face up.

The player 302 may fold at this point, or otherwise place a bet 308. In the example of FIG. 3, the player 302 places a $5 bet 308 in addition to the previously-submitted ante. The dealer 300 then exposes the two-card hand 310 (or otherwise perceives the value of the hand in an electronic version). As shown at stage 314, the dealer 300 calls the player's bet ($5 in the illustrated embodiment), and deals the community hand 316 to create the board 318. As shown at stage 320, the dealer's 300 and player's 302 poker hands are derived using their respective two-card starting hands 310, 312 and the communal hand 316, the winner is determined, and the bets are settled. In this example, the player's 302 best hand is a full house (Q,Q,Q,5,5) 322, and the dealer's 300 best hand is two pair (Q,Q,2,2) 324. Therefore, the player 302 wins the bets called by the dealer, and arrives at a net win amount corresponding to the dealer's 300 total bet 326 with gross winnings taking into account any dealer-bias rules, such as for handling the initial commission.

In one version, the dealer-bias rules require that unless the player beats the dealer by a certain level of poker ranking, the player's ($1) commission is forfeit to the dealer; if the player beats the dealer by the specified differential ranking level, the player takes all. For example, assume that the player's full house (Q,Q,Q,5,5) 322 is ranked as two levels above the dealer's two pair (Q,Q,2,2) 324 and that the differential to take all is at least two levels. In this instance and as shown in FIG. 3, the player takes all with the player's winnings being equal to the total betting pool of $12. If, however, the player's full house (Q,Q,Q,5,5) 322 were ranked only one level above the dealer's two pair (Q,Q,2,2) 324 and the differential to take all is at least two levels, the player's net winnings would not include the ($1) commission initially put up by the dealer; thus, these winnings equate to $11, broken down as follows: the total betting pool ($1 ante from each of the dealer and player plus the called bet of $5 from each of the dealer and player) minus the ($1) commission put up by the player.

Figure 4:
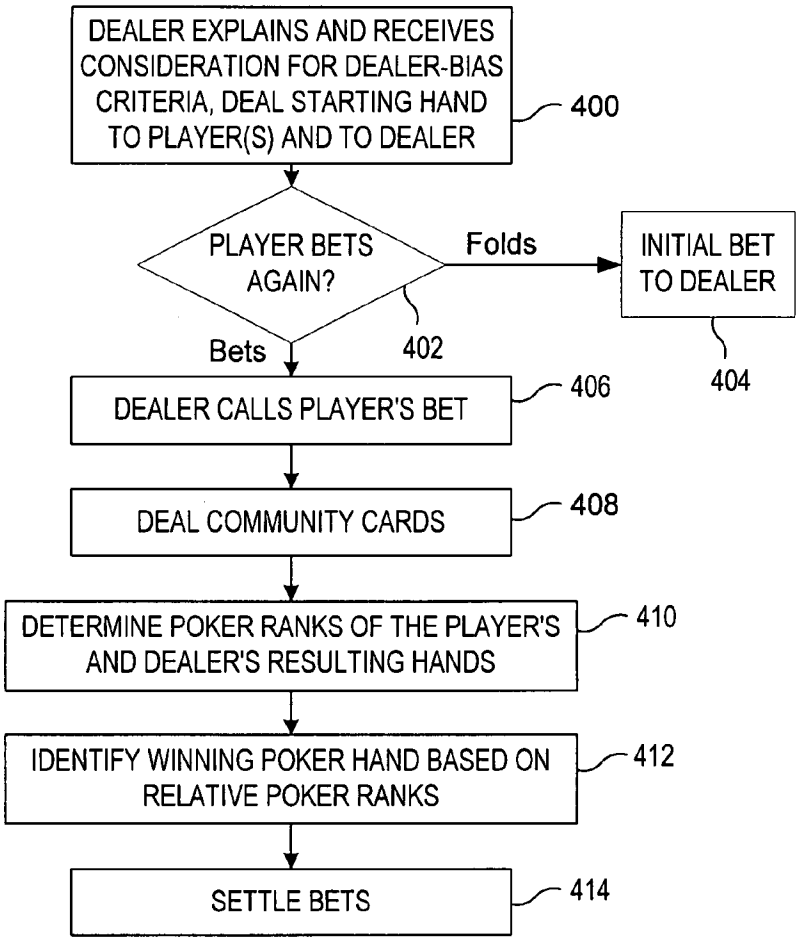
FIG. 4 is a flow diagram illustrating an embodiment of a method that relates to the embodiment of FIG. 1, also in accordance with the present invention

FIG. 4 illustrates another card game embodiment that relates to the embodiment of FIG. 1 and that is also in accordance with the present invention. As with the above-described embodiments, the general example provided in connection with FIG. 4 can be altered to incorporate rules of various types of poker-type card games, such as "Hold'em." At block 400, each player puts up an initial commission before receiving two cards. In this example and as previously discussed, the initial commission provides the consideration necessary to prevent the player from realizing even money or better. The dealer then also receives two cards and, depending on the game rules, none, one or both of these dealer-dealt cards are exposed.

At block 402, after looking at his cards, the player decides either to fold or to make a second bet. If the player decides to fold, the player loses the initial commission to the house as depicted at 404. In most versions this second bet would be restricted to a specific multiple of his commission. That multiple may be five; for example, if the players commission was $15 and he elected to not fold the player would have to bet $75 more.

Unlike All In Hold'em (as described in the previously-mentioned patent document), there is no qualifier for this game as far as the dealer is concerned. As depicted at 406, the dealer must call all bets allowable within the rules of the game. At block 408, community cards may then be dealt. Then, as shown at blocks 410 and 412, respectively, the poker ranks of each hand are determined and winning hands are identified. Per block 414, if the dealer winds up beating the player, the dealer's winnings include both the initial commission and the second bet. In the above example where the initial commission is $15 and the second bet is $75, the dealer would win $90. If the dealer loses, the dealer pays the player less than these anticipated winnings; in the above example, this would be less than $90. In one specific version, if the dealer loses, the dealer would pay $75 to the player, meaning he paid the second bet while the initial commission is not refunded.

In accordance with the present invention, the dealer pays less than even money when he must call all bets because the player would clearly have an advantage if even money was paid. The player would have no disadvantage in such a game if he blindly bet every hand rather than ever fold. However, with the dealer not having the option of folding, because there are times when the player would be correct to fold, the player would have an overall advantage if he played correctly. To compensate for this, the game is biased to favor the dealer so that, on average, the dealer pays less than even money. In the above-illustrated example, the initial commission (e.g., $15) put up by each player (block 100 of FIG. 1) is used as the criteria providing such a dealer-biased outcome.

As discussed herein, there can be various types of modifications. The following are examples: a limitation to the dealer's access to the community hand; a selection of the number of hands in which a tie goes the dealer; and/or for a given number of hands to be played, rules that influence the dealer bias for certain ones of these hands to be player.

Figure 5:
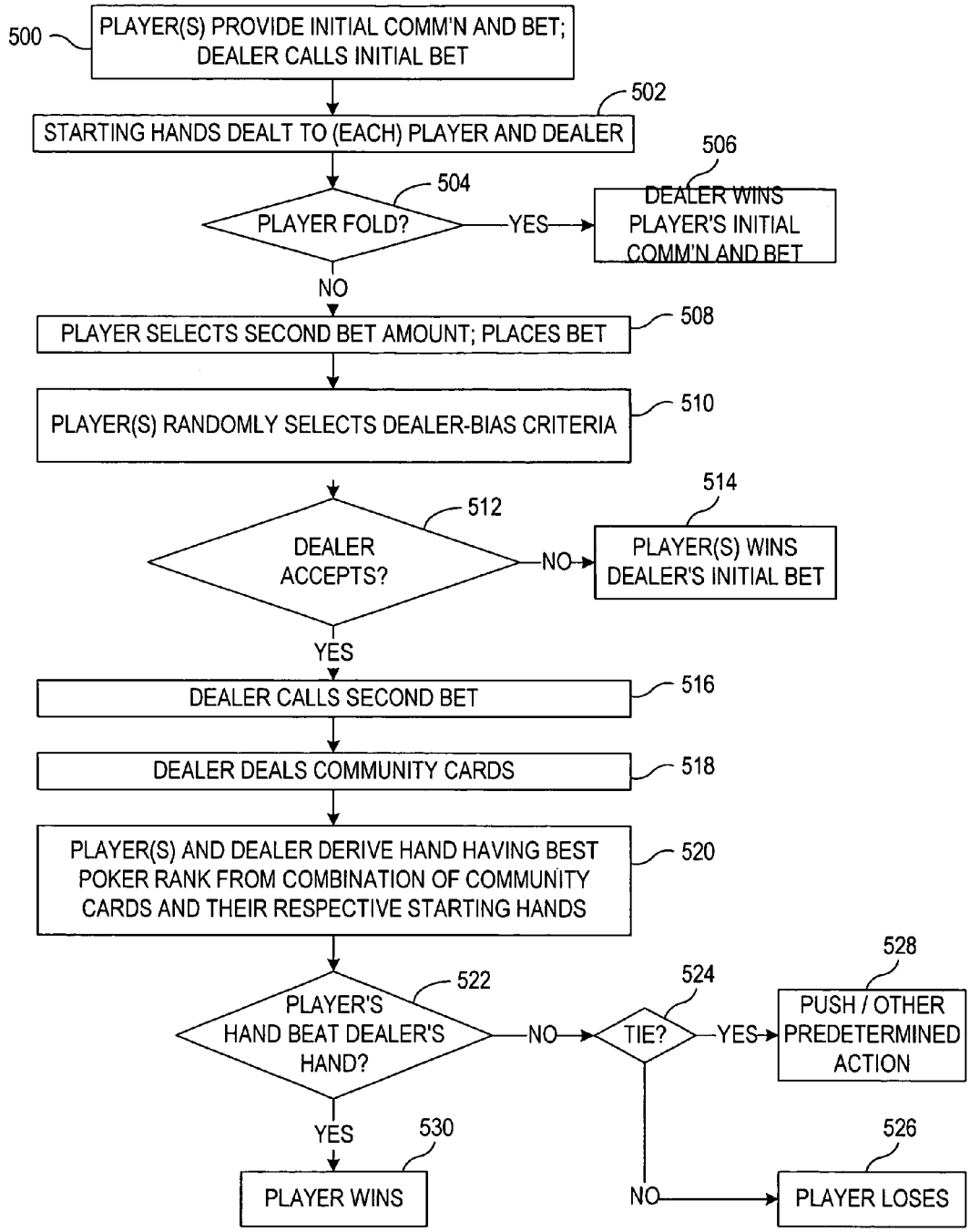
FIG. 5 illustrates another embodiment of a manner of participating in yet another card game in accordance with the present invention.

FIG. 5 illustrates another embodiment of a manner of participating in a card game in accordance with the present invention, where the player may pay to randomly limit the dealer's chances at winning, and the dealer can accept this limit chance or reject and fold. In the embodiment of FIG. 5, the player(s) provides any required initial commission and an ante/initial bet and the dealer calls the bet, as shown at block 500. Starting hands are dealt 502 to the player(s) and to the dealer. The player may fold, and if the player folds as determined at decision block 504, the dealer wins 506 the player's ante. If the player does not fold, the player selects a bet amount, and places the selected bet as shown at block 508. For example, the player may select a $10 bet among bet choices of $5 and $10.

By placing the second bet at block 508, the player is entitled to randomly select 510 a limitation to the dealer's chances of winning. This selection may be achieved, for example, by spinning a wheel or through dice, with the outcome being a selection of one of several types of limitations to the dealer's chances of winning. These limitations may be, for example: 1) dealer being prohibited from playing highest value card in the community hand; 2) dealer being prohibited from playing highest value card in the community hand; 3) dealer being prohibited from playing more than any two cards in the community hand; and 4) an amount related to the initial commission being added to the betting pool. Based on the outcome, the dealer decides, as depicted at 512, whether to accept the limitation and continue playing. If the dealer rejects the limitation, he folds and the player wins, as depicted at 514. If the dealer continues to play, the dealer calls 516 the player's bet or otherwise makes a second bet in response to the player's bet, and deals 518 the community cards. The player and dealer each derive 520 a hand having the best poker rank from a combination of the community cards and their respective starting hands. For example, where the starting hands are two-card starting hands and the communal hand is a five-card hand, the player and the dealer will derive the best five-card poker hand based on the seven cards comprising the community hand and their respective two-card starting hands. If the player's hand does not beat the dealer's hand as determined at decision block 522, the dealer/house has either won the hand or a tie has occurred. If it is not a tie as determined at decision block 524, the player loses 526 the hand; i.e., the dealer/house wins the player's ante and second bet(s). If there is a tie, house rules or other predetermined rules will dictate the action, as shown at block 528. For example, a tie may result in a push, or alternatively the rules may award the win to one or the other of the dealer or player.

Again, the present invention is not limited to any particular rules for ties, as any desired rules may be provided for ties in accordance with the present invention.

FIG. 6 is a table illustrating a number of exemplary game plays and corresponding results in accordance with the present invention. Each game play is described in terms of a player's two-card starting hand 600 and ensuing player action 602, the dealer's two-card starting hand 604 and ensuing dealer action 606, a five-card community hand 608, and the "net" result 610 to the player. For purposes of this example, it is assumed the player's ante is $1, the dealer has no ante (bias favoring the dealer), and the player can choose as a subsequent bet, an amount of $5 or $10. For purposes of this example, it is also assumed that a conventional poker rank is used, such as set forth in Table 1 below:

TABLE 1

| Poker Rank | |
|---|---|
| Hand | Example |
| Royal Flush | A, K, Q, J, 10 (suited) |
| Straight Flush | 3, 4, 5, 6, 7 (suited) |
| Four Of A Kind | 8, 8, 8, 8, 5 |
| Full House | 10, 10, 10, J, J |
| Flush | 3, 6, 8, J, Q (suited) |
| Straight | 5, 6, 7, 8, 9 (unsuited) |
| Three Of A Kind | Q, Q, Q, 2, 3 |
| Two Pair | A, A, J, J, 10 |
| One Pair | Q, Q, 4, 5, 9 |
| High Card In Hand | A, Q, 4, 5, 8 |

It is also noted that for purposes of the example of FIG. 6, no suited hands, such as any type of flush, are considered for ease of illustration.

In a first game play 612, the player has a starting hand 600 of (7,2). The player decides 602 to fold, and therefore the dealer starting hand 604, dealer action 606, and community hand 608 is irrelevant to this player for this game 612. The net result 610 to the player is that the player loses his/her commission of $1.

In game play 616, the player has a starting hand 600 of (J,2). The player does not fold, and instead decides 602 to bet $5. The dealer has a starting hand 604 of (10,6). The dealer action 606 is to call the bet, and deal the community cards 608 which are (J,8,5,3,2). In this case, the player obtains two pair (J,J,2,2), and the dealer obtains only a J-high hand. The result 610 is therefore that the player receives a net win of $4, corresponding to the dealer's $5 call bet minus the $1 player commission.

In game play 618, the player has a starting hand 600 of (5,5). The player does not fold, and instead decides 602 to bet $5. The dealer has a starting hand 604 of (8,8). The dealer action 606 is to call the bet, and deal the community cards 608 which are (8,8,5,5,2). In this case, the player obtains a 5-high four-of-a-kind (5,5,5,5), but the dealer obtains an 8-high four-of-a-kind (8,8,8,8). The result 610 is therefore that the player loses the commission and bet, for a total loss of $6. It should be noted that in one embodiment of the invention, the player is still eligible for bonus awards if the player's hand beats the dealer's hand by a certain value and/or with certain winning card hands. Such bonus awards can vary. In one embodiment of the invention, a player can receive an additional bonus if the player obtains a hand that corresponds to a predetermined poker rank. Such bonus payouts may be made in any desired manner. Table 2 illustrates an example of such a bonus payout schedule.

TABLE 2

| Bonus Table | | |
|---|---|---|
| Hand | Example | Bonus |
| Royal Flush | A, K, Q, J, 10 (suited) | ×20 |
| Straight Flush | 3, 4, 5, 6, 7 (suited) | ×10 |
| Four Of A Kind | 8, 8, 8, 8, 5 | ×5 |

Thus, if a player obtains four-of-a-kind, a multiplier of 5 is applied to the player's winnings. According to the bonus table of Table 2, a straight flush results in a multiplier of 10, and a royal flush results in a multiplier of 20. Alternatively, fixed monetary values may be provided by the bonus rather than multiplier values. Further, bonuses may be implemented for any type of hand with the desired multiplier/value associated therewith.

In another embodiment, had the dealer won the hand (e.g., four Kings), the player may still be eligible for a bonus award. In such an embodiment, a particular value rather than a multiplier may be used, or the entire bonus schedule may be based on particular values rather than multipliers.

Figure 7A:
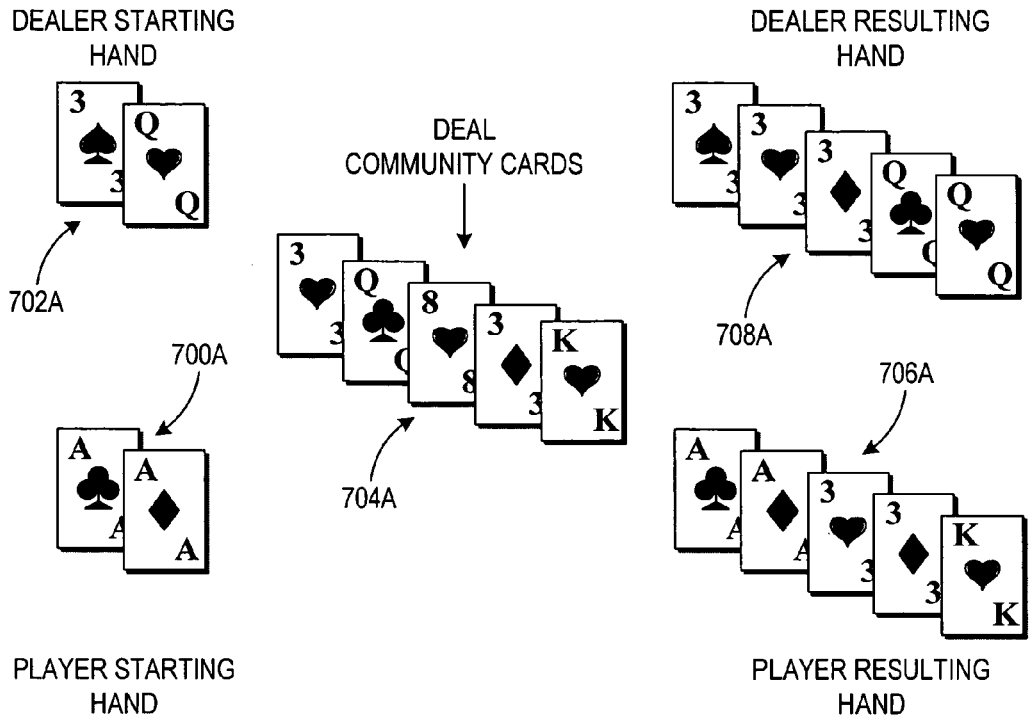
FIGS. 7A and 7B illustrate the ability for any participant to be in the running for the highest payouts, or to lose when initially having a strong starting hand, even though the bets are already in place.
Figure 7B:
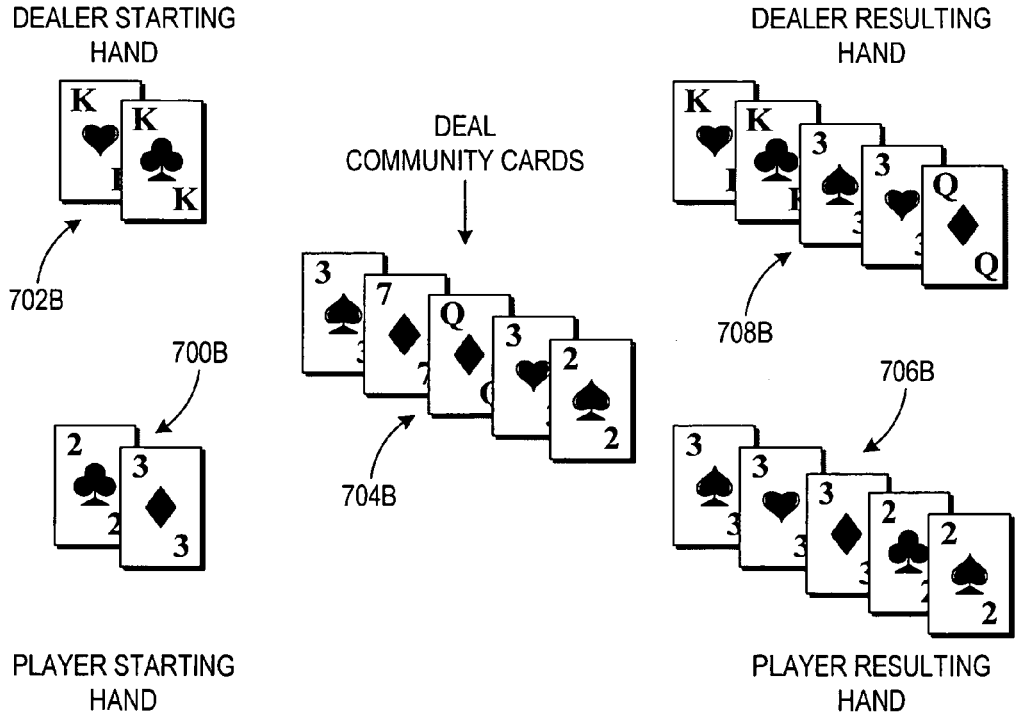

As can be seen from the foregoing examples, a player may receive a poor starting hand from a poker rank perspective, yet still be in the game and ultimately win the full amount. In other words, even though the player starts out with a poor hand, the fact that post-bet communal cards are presented leaves the player in a position to still be able to beat the dealer outright. On the other hand, even if the player has a good starting hand from a poker rank perspective, the player could still lose to the dealer who may have a poor starting hand. FIGS. 7A and 7B illustrate this. In FIG. 7A, the player starting hand 700A is better from a poker rank perspective than the dealer starting hand 702A. The communal hand 704A is dealt, and the ultimate result is that the dealer obtains a full house (3,3,3,Q,Q) 708A and the player obtains two pair (A,A,3,3) 706A. Even though the player started with a better starting hand than the dealer, the player did not win the hand. Conversely, as illustrated in FIG. 7B, the player starting hand 700B is worse from a poker rank perspective than the dealer starting hand 702B. The communal hand 704B is dealt, and the ultimate result is that the player obtains a full house (3,3,3,2,2) 706B and the dealer obtains two pair (K,K,3,3) 708B. Even though the player started with a worse starting hand than the dealer, the player won the hand.

Figure 8:
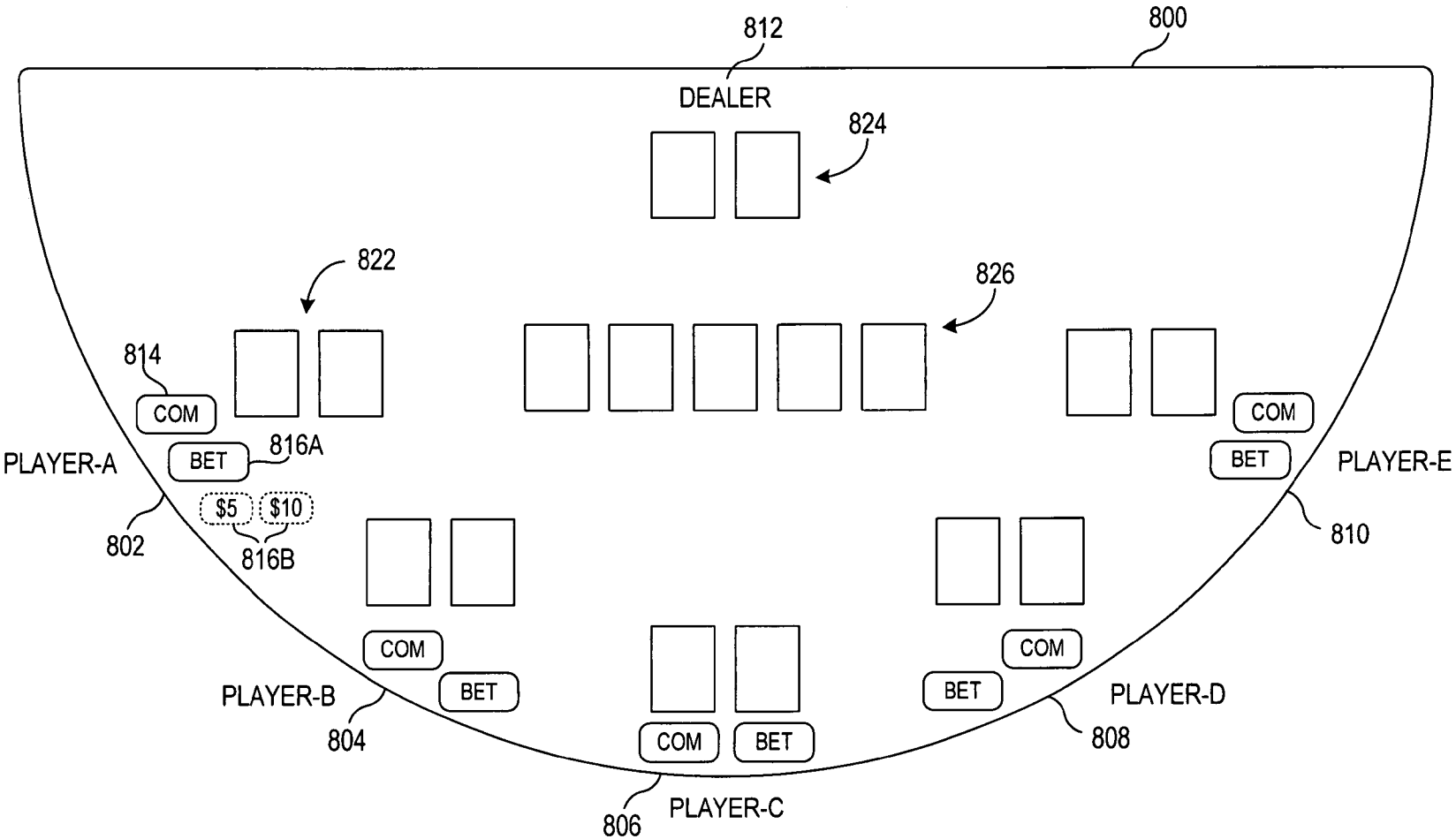
FIG. 8 illustrates an example of a table layout for use in playing live casino versions of the poker game in accordance with the invention.

A card game according to the present invention may be implemented in live table versions. An example table layout 800 is illustrated in FIG. 8 for use as a gaming table cover or top surface in playing live casino versions of the poker game in accordance with the invention. The embodiment of FIG. 8 includes a plurality of player locations 802, 804, 806, 808, 810 spaced around an arcuate peripheral edge at which one or more players will sit or stand during play of the game. The dealer may face the players from a dealer location 812, such as behind the straight edge of the layout 800. The layout 800 may be formed from a felt material in a manner known in the art, for example, in connection with conventional Twenty-One table layouts. Alternatively, the layout may be physically incorporated into the surface of a gaming table.

Each of the player locations, for example, player location 802, may include wagering indicia, such as a commission area 814 and bet area 816A. By placing a coin(s), bill(s), marker(s), chip(s) or other token(s) to be associated with the commission area 814, the player pays to play the game. Similarly, by placing a coin(s), bill(s), marker(s), chip(s) or other token(s) to be associated with the bet area 816A, the player makes his/her bets. Such a bet area 816A may be used for embodiments allowing only a single fixed bet (e.g., $5), or in embodiments that involve multiple bets (e.g., $5 and $10; bets within a range, etc.). Alternatively, separate indicia 818B may be used to place bets of different values for embodiments allowing bets of different values. This may be beneficial, for example, to the dealer to more easily determine what the dealer-bias criteria will be for (and/or from) each player. It should be noted that no such indicia 814, 816A, 816B is required at all in other embodiments, as the value of the bets placed by the players may be self-explanatory.

The dealer accepts the dealer-bias criteria as offered by each player and deals the starting hands, such as player starting hand 822 and dealer starting hand 824. Each non-folding player makes a wager. The dealer calls the bets of each of the participating players, and deals the community hand 826. The players' cards are turned face-up, and the best poker hand from their respective starting hands (e.g., 822) and the community hand 826 is determined. The dealer pays out for players whose resulting poker hands beat the dealer's resulting poker hand, and the house takes the bets of the losing players. In the event of a tie, no money is exchanged (i.e., "push"), or other predetermined rules may be followed.

Figure 9:
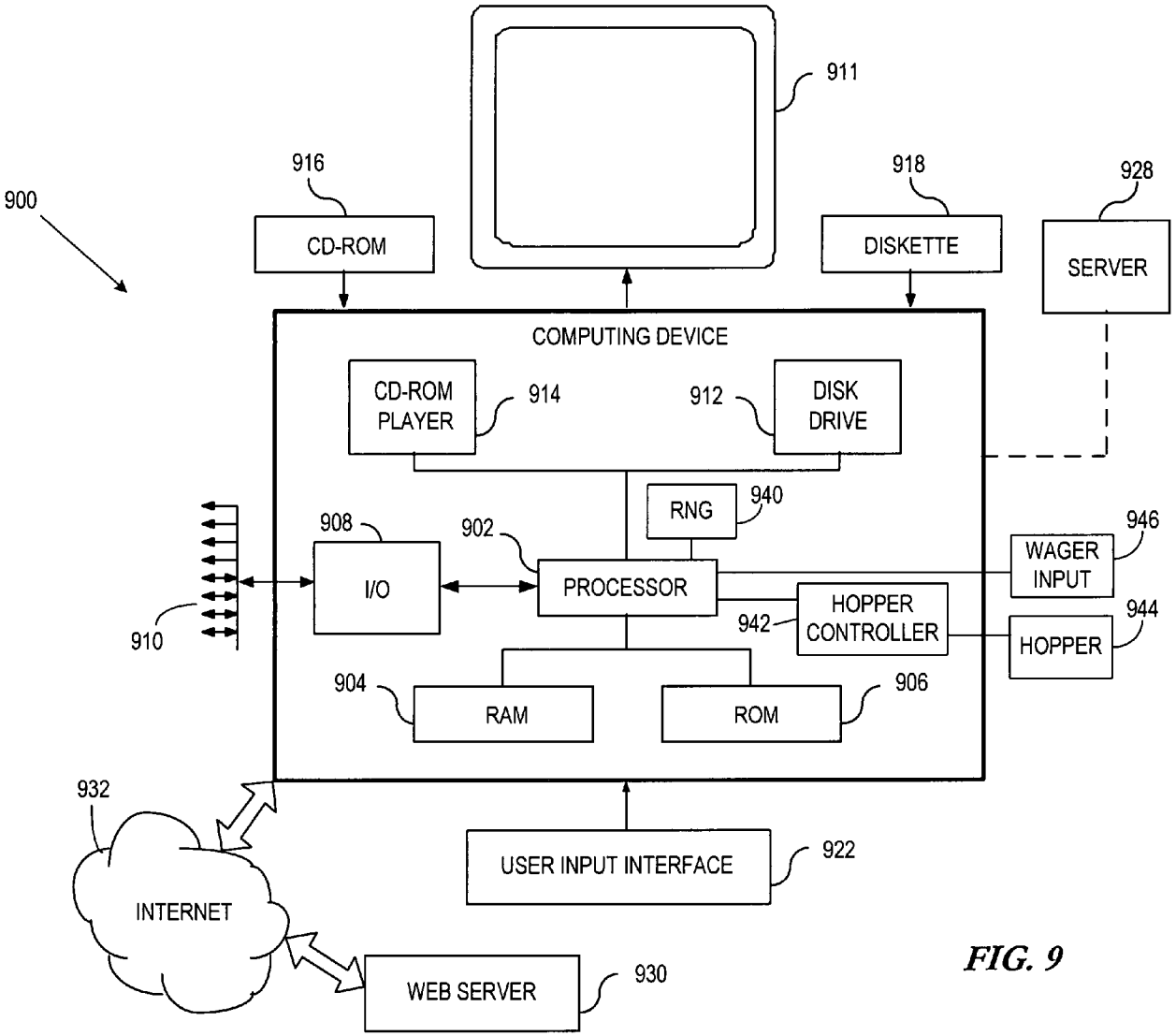
FIG. 9 illustrates a representative computing system capable of carrying out operations in accordance with the invention.

The present invention may also be implemented as a casino gaming machine such as slot machines or other special purpose gaming kiosks, video games, or may be computing systems operating under the direction of local gaming software and/or remotely-provided software such as provided by an application service provider (ASP). The casino gaming machines utilize computing systems to control and manage the gaming activity. An example of a representative computing system capable of carrying out operations in accordance with the invention is illustrated in FIG. 9.

Hardware, firmware, software or a combination thereof may be used to perform the various gaming functions, display presentations and operations described herein. The functional modules used in connection with the invention may reside in a gaming machine as described, or may alternatively reside on a stand-alone or networked computer. The computing structure 900 of FIG. 9 is an example computing structure that can be used in connection with such electronic gaming machines, computers, or other computer-implemented devices to carry out operations of the present invention.

The example computing arrangement 900 suitable for performing the gaming functions in accordance with the present invention typically includes a central processor (CPU) 902 coupled to random access memory (RAM) 904 and some variation of read-only memory (ROM) 906. The ROM 906 may also be other types of storage media to store programs, such as programmable ROM (PROM), erasable PROM (EPROM), etc. The processor 902 may communicate with other internal and external components through input/output (I/O) circuitry 908 and bussing 910, to provide control signals, communication signals, and the like.

Chance-based gaming systems such as slot machines, in which the present invention is applicable, are governed by random numbers and processors. A monitor 911 or other display device is used to display the gaming activity as facilitated by a random number generator (RNG). RNGs are well-known in the art, and may be implemented using hardware, software operable in connection with the processor 902, or some combination of hardware and software. A processor 902 associated with the system, under appropriate program instruction, can simulate the dealing of cards. The present invention is operable using any known RNG, and may be integrally programmed as part of the processor 902 operation, or alternatively may be a separate RNG controller 940.

The computing arrangement 900 may also include one or more data storage devices, including hard and floppy disk drives 912, CD-ROM drives 914, and other hardware capable of reading and/or storing information such as DVD, etc. In one embodiment, software for carrying out the operations in accordance with the present invention may be stored and distributed on a CD-ROM 916, diskette 918 or other form of media capable of portably storing information. These storage media may be inserted into, and read by, devices such as the CD-ROM drive 914, the disk drive 912, etc. The software may also be transmitted to the computing arrangement 900 via data signals, such as being downloaded electronically via a network, such as the Internet. Further, as previously described, the software for carrying out the functions associated with the present invention may alternatively be stored in internal memory/storage of the computing device 900, such as in the ROM 906. The computing arrangement 900 is coupled to the display 911, which represents a display on which the gaming activities in accordance with the invention are presented. The display 911 merely represents the "presentation" of the video information in accordance with the invention, and may be any type of known display or presentation screen, such as LCD displays, plasma display, cathode ray tubes (CRT), etc. Where the computing device 900 represents a stand-alone or networked computer, the display 911 may represent a standard computer terminal or display capable of displaying multiple windows, frames, etc. Where the computing device is embedded within an electronic gaming machine (see FIG. 10), the display 911 corresponds to the display screen of the gaming machine/kiosk. A user input interface 922 such as a mouse, keyboard, microphone, touch pad, touch screen, voice-recognition system, etc. may be provided.

The computing arrangement 900 may be connected to other computing devices or gaming machines, such as via a network. The computing arrangement 900 may be connected to a network server 928 in an intranet or local network configuration. The computer may further be part of a larger network configuration as in a global area network (GAN) such as the Internet. In such a case, the computer accesses one or more web servers 930 via the Internet 932.

Other components directed to gaming machine implementations include manners of gaming participant payment, and gaming machine payout. For example, a gaming machine including the computing arrangement 900 may also include a hopper controller 942 to determine the amount of payout to be provided to the participant. The hopper controller may be integrally implemented with the processor 902, or alternatively as a separate hopper controller 942. A hopper 944 may also be provided in gaming machine embodiments, where the hopper serves as the mechanism holding the coins/tokens of the machine. The wager input module 946 represents any mechanism for accepting coins, tokens, coupons, bills, credit cards, smart cards, membership cards, etc. for which a participant inputs a wager amount.

As indicated above, the present invention may be implemented in stand-alone video poker versions. An electronic video poker device of the general type suitable for use in the practice of the game according to the present invention is generally illustrated in FIG. 10.

Figure 10:
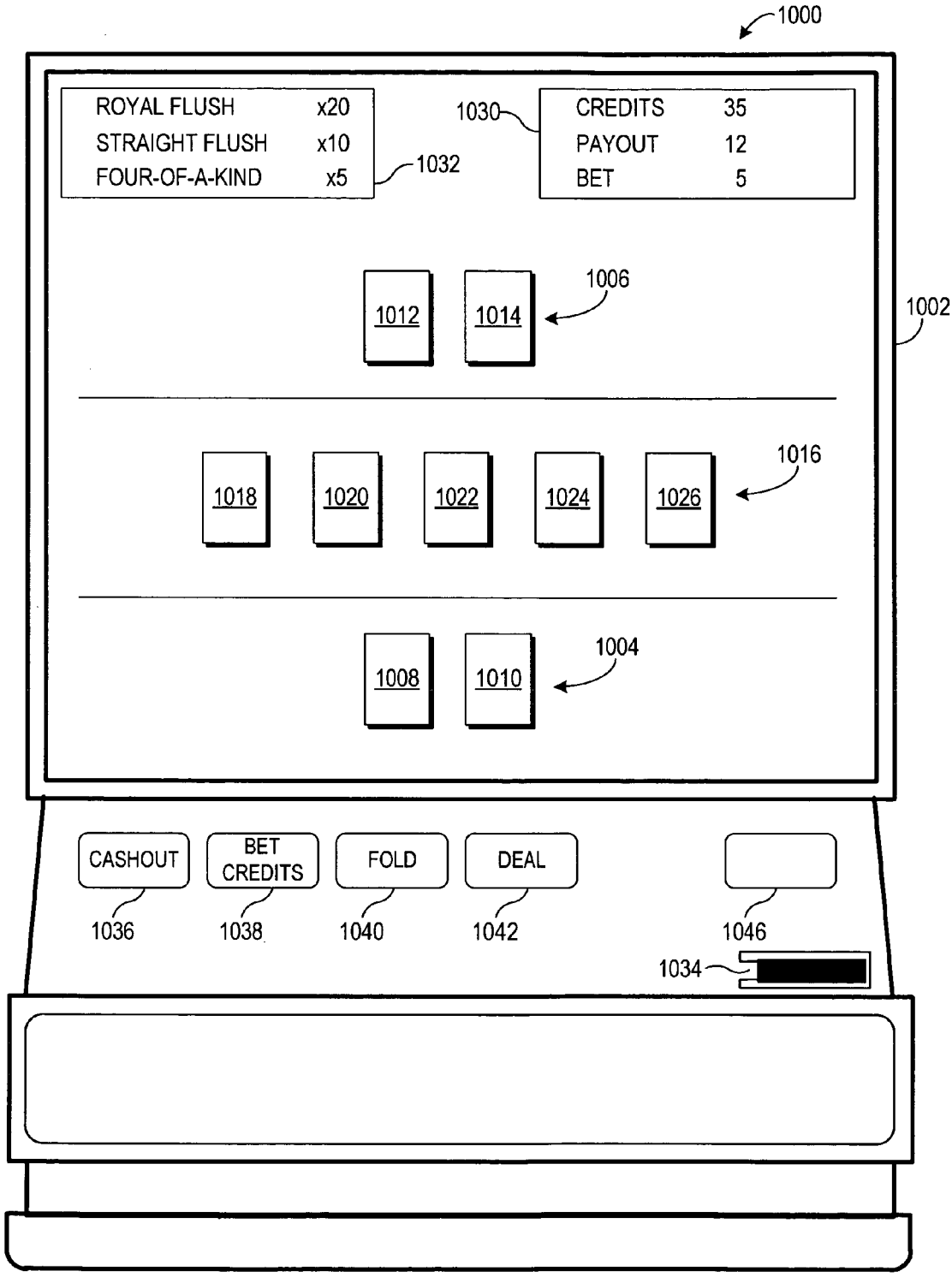
FIG. 10 illustrates a representative electronic video poker device of the general type suitable for use in the practice of the game according to the present invention.

As depicted in FIG. 10, the electronic video poker device 1000 includes a display screen 1002 operative in a well known manner to display representations of conventional playing cards thereon. In accordance with the present invention, a central processing unit (CPU; not shown) of the device 1000 is instructed pursuant to one or more computing programs which may, for example, be stored in a read-only memory (ROM), programmable read-only memory (PROM) or other storage medium of the internal circuitry. The stored program code may be selectively determined, within the ambit of a programmer of ordinary skill in the art, having the benefit of the instant disclosure, to enable the electronic device 1000 to play the card games of the present invention. A first portion of the display screen 1002 is operative to display, face-up, at least one starting hand 1004 for the player, and to display a starting hand 1006 for the dealer which is dealt face-down in one embodiment of the invention. The player starting hand 1004 includes screen card representations 1008, 1010, and the dealer starting hand 1006 includes screen card representations 1012, 1014. In accordance with generally known technology in the field of video poker machines, the CPU of the device 1000, under appropriate program instruction, may accurately simulate the random dealing of each of the starting hands from one or more conventional card decks. Another portion of the display screen 1002 is similarly operative to display the community hand 1016 associated with the game. In the example of FIG. 10, the community hand includes five community cards, including cards 1018, 1020, 1022, 1024, 1026.

A display segment or panel 1030 may be provided to display the value of the current bet, for example 5 tokens (where tokens may represent, for example, nickels, dimes, quarters, dollars, etc.), the number of accumulated credits, and the number of tokens paid out. A display segment or panel 1032 may be provided to display a bonus table, if one is available for the game.

A token acceptor 1034 is operative to receive wager tokens, or alternatively, coins, bills, credit/debit cards, coupons, smart cards, prepaid casino cards, and the like. Various control buttons 1036, 1038, 1040, 1042, 1046 allow the player to make control inputs during play of the game of the present invention. In an example manner of play of the electronic video poker device 1000, a player first enters tokens, coins, prepaid card, credit card, or the like into the acceptor 1034 to acquire a credit balance on credit display 1030. If desired, the player may alternatively place each bet individually after each hand by inserting coins, tokens, bills, etc.

By pressing the DEAL button 1042, the player's and dealer's starting hands 1004, 1006 may be dealt. A FOLD button 1040 allows the player to fold if desired. If the player folds, the commission amount is forfeited. If the player does not fold, the player may activate the BET CREDITS button 1038 one or more times to place a wager which is displayed by bet display 1030. In one embodiment, repeated activation of the BET CREDITS button 1038 will increase the player's bet. In another embodiment, additional BET CREDITS buttons may be provided, where each of such buttons may be associated with a different bet amount. The electronic device 1000 may be programmed to limit the number of tokens that can be bet on a single hand. Such a limit is dependent on a predetermined limit of credits per hand (as well as the number of concurrent hands that will be played in an embodiment allowing multiple community hands to be concurrently played with the player's starting hand 1004).

The DEAL button 1042 may be used to initiate the rest of the play. For example, pressing the DEAL button 1042 may cause the dealer's starting hand 1006 to be compared against the appropriate threshold criteria, as discussed above to change the odds (e.g., negating or increasing a possible bonus payout situation. Alternatively, such action may automatically occur in response to the player making a bet of a certain amount.

When (and if) the bets have been placed and the community hand 1016 has been dealt, the winning hand is identified. The CASH OUT button 1036 can be used to allow the player to cash out any accumulated credit balance.

As may now be readily understood, the device 1000 may be programmed to play various embodiments of the invention. Alternatively, the device may include a control input to allow a player to select play of different variations of the game. In connection with certain embodiments of the invention, the device 1000 may be programmed to make appropriate bonus payouts. For example, bonus payouts may be made in accordance with the odds set forth in Table 2 above, but may be made in any predetermined manner.

In another embodiment of the invention, multiple community hands may be played concurrently by one or more of the players in the game. This may be implemented in both table games as well as electronic versions. For purposes of illustration, such a version is described in connection with an electronic game, although the principles are equally applicable to a live table game.

Figure 11:
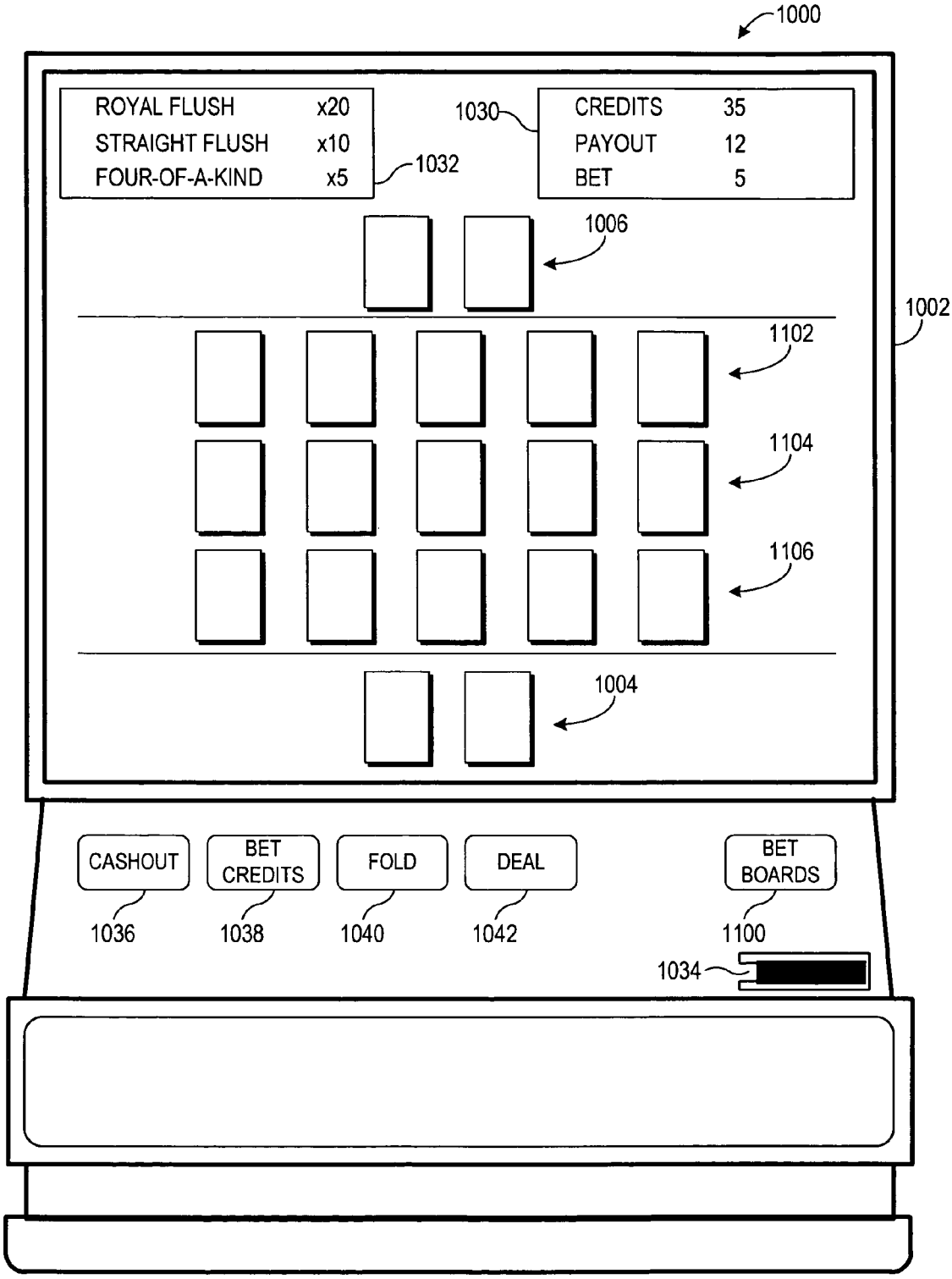
FIG. 11 illustrates a representative embodiment illustrating one manner for concurrently participating in multiple hands for the game according to the present invention.

The embodiment of FIG. 11 corresponds to the embodiment of FIG. 10, and the reference numbers of FIG. 10 are used in FIG. 11 where appropriate. The embodiment of FIG. 11 differs from the embodiment of FIG. 10 in that up to three boards may be concurrently played by the player. Any number of boards may be implemented, and three boards are used in the embodiment of FIG. 11 for purposes of illustration only. In this embodiment, the game is played as previously described, but the player may select one, two, or three boards to be concurrently played. If the player chooses to play three boards, the player may identify the number of boards to play by, for example, using the BET BOARDS button 1100. The player can press the DEAL button 1042, and the player's and dealer's starting hands 1004, 1006 may be dealt. Alternatively, the starting hands 1004 and 1006 may automatically be dealt upon the player placing a commission.

The FOLD button 1040 allows the player to fold on any, all, or none of the concurrent hands that will be played. If the player folds for any hand, the corresponding commission amount is forfeited. If the player does not fold, the player may activate the BET CREDITS button 1038 one or more times to place a wager which is displayed by bet display 1030. In one embodiment, different bet amounts may be placed for each of the concurrent hands being played, or all hands may be subject to a common bet amount.

The DEAL button 1042 may be used to initiate the rest of the play. For example, pressing the DEAL button 1042 may cause the dealer's starting hand 1006 to be compared against the bonus-modifying threshold and/or to pay an amount immediately perhaps subject to a special condition (such as the dealer's exposed card having a certain value). The dealer calls the bets and deals the number of community hands 1102, 1104, 1106 selected by the player. Alternatively, such action may automatically occur in response to the player making a bet.

When (and if) the bets have been placed and the community hands 1102, 1104, 1106 identified by the player for play have been dealt, winning hands are determined for each of the concurrently-played hands. For example, a first resulting dealer hand will be determined using the dealer starting hand 1006 and community hand 1102, which will be compared against a first resulting player hand using the player starting hand 1104 and the community hand 1102. Bets for this hand will be settled. If the player selected to concurrently play another hand, a second resulting dealer hand will be determined using the dealer starting hand 1006 and community hand 1104, which will be compared against a second resulting player hand using the player starting hand 1104 and the community hand 1104, and bets for this hand will be settled. This continues for each of the number of concurrent boards selected by the player.

It should be noted that such a game may not allow for player selection of the number of concurrent games, but rather the game may be a fixed, concurrent-play game. For example, the game may require the player to participate in three hands concurrently. It should also be noted that such a concurrent-play game is equally applicable to a live table version of the game according to the present invention. The concurrent play in accordance with the present invention may be determined in a manner as set forth herein, and in connection with a system and method as described in U.S. patent application Ser. No. 10/351,983 filed on Jan. 27, 2003, and in U.S. Pat. No. 6,511,068 issued on Jan. 28, 2003, both of which are incorporated herein in their entirety.

In accordance with another embodiment of the invention, multiple dealers/multiple house hands may be implemented. For example, in a live table version, the dealer may deal multiple dealer starting hands (i.e., multiple starting hands to the dealer), or alternatively two or more dealers may each deal a starting hand to themselves. This allows the player to participate in multiple games or to allow the game to be played in a different manner. In an electronic version, multiple dealer starting hands would be presented.

More particularly, consider for purposes of illustration an embodiment involving a live table version of the game, where one dealer deals two starting hands to himself/herself as multiple dealer starting hands. For purposes of illustration, it will be assumed that the dealer will have two starting hands, although the number can be greater than two. The player may provide two commissions, one for each of the dealer starting hands. In one embodiment, the player is dealt a single starting hand, although there are multiple dealer starting hands. In one embodiment, the player may fold on one or both bet opportunities, thereby forfeiting each respective commission, or may otherwise place a bet against the hands of either or both of the dealers. In one embodiment, the dealer then deals a single community hand to be used with the player's starting hand and each of the dealer's starting hands. The player's resulting hand is compared against each number of the dealer's resulting hands and the bets are settled.

Such an embodiment may be particularly interesting in situations such as where the player is given the opportunity to make multiple bets when receiving a good starting hand. For example, the player may decide to play against two dealer hands, and thus provides two commission. If the player was to receive a good starting hand such as a pair, the player can bet on both hands, and in fact may opt to bet a higher bet amount where multiple bet amounts are allowed. The player would also have the opportunity to fold on one hand and bet on the other, which may occur if the player believes his/her hand will beat one dealer but not the other, or if the player's hand is not good enough to risk losing two bets, or the like.

In one embodiment, the player plays against each dealer/dealer hand independently, in that the player may lose the bets to both dealer hands, may win one bet and lose the other bet, or may win both bets. In another embodiment, the player may have to beat both (or all where more than two) dealer hands in order to win any amount. For example, if the player's resulting hand beats none or one of the dealer hands, the player would lose. However, in such an embodiment where the player needs to beat both dealer hands, the return may be greater. For example, if the player bet $5 for each of the two dealer hands and the player's resulting hands beats both dealer resulting hands, the player may net, for example, $10 for each of the dealer hands for a net win of $20 (rather than a net win of $10 total).

In one embodiment of the invention, the dealer may simply deal multiple dealer starting hands, and the player may, or may not, opt to commission for both hands. If the player provides one commission, the player would play in the normal fashion against one of the dealer's starting hands, which may be designated in some manner as the dealer's primary starting hand. If the player provides a second commission, the player would play against both dealer hands. In such an embodiment, the dealer deals multiple dealer starting hands to afford each player the opportunity to play against multiple dealer hands, but the player is not required to. The dealer will know whether the player is playing against one or both (or more) dealer starting hands by the player. If the player chooses to play against multiple dealer hands, the player commission may be the same amount or a different amount for each of the dealer hands.

In another embodiment, the game includes the player providing a selection-enabling commission for adjusting the rules of the game, for example, in connection with the number of hands to be played before a bonus winning can be considered as an additional payout. In such versions, the selection-enabling commission is used to select a certain number of hands (say 10 hands) to be played and of those hands, the number of hands in which initial commission automatically goes to dealer, whether a tie goes to the player or the dealer, and/or the number of hands in which initial commission is part of betting pool. In other versions, before determining a dealer's rank, player can pay to select a doubling function so as to double amount of betting pool; this can occur, for example, in connection with stage 510 of FIG. 5.

Accordingly, important aspects of the present invention involve use of one or more forms of a dealer-favored bias criteria that provides an increased challenge for the player and an incentive component for both the dealer and the player. Since the dealer automatically calls in response to the player's bet, the dealer-bias criteria is used to tilt the odds of winning in favor of the dealer. To a large degree, this advantage is useful in providing additional excitement and challenge, as well as the associated anticipation, to the players.

The foregoing description of the exemplary embodiment of the invention has been presented for the purposes of illustration and description. It is not intended to be exhaustive or to limit the invention to the precise form disclosed. Many modifications and variations are possible in light of the above teaching. It is intended that the scope of the invention be limited not with this detailed description, but rather set forth by the claims appended hereto.

What is claimed is:

1. A method for playing a communal card poker game between one or more players and a dealer, comprising:

requiring each player to submit an initial commission to participate in a hand of the communal card poker game;

facilitating placement of a wager, distinct from the initial commission, by each of the one or more participating players;

requiring the dealer to call the wagers placed by the one or more players;

determining a hand outcome based on a comparison of the respective resulting hands of each of the players and the resulting hand of the dealer, each of the resulting hands comprising a subset of a set of cards including a plurality of community cards and a respective starting hand for each of the players and the dealer;

providing payouts to any of the one or more players whose resulting hand has a higher poker rank than the resulting hand of the dealer; and the dealer collecting the initial commission of each player.

2. The method of claim 1, wherein the dealer collecting the initial commission comprises the dealer collecting the initial commission regardless of the hand outcome.

3. The method of claim 1, further comprising the dealer returning the initial commission to each player that won the player's placed wager.

4. The method of claim 1, wherein facilitating placement of a wager by each of the one or more participating players comprises facilitating placement of a wager in any amount not greater than a predetermined multiple of the initial commission.

5. The method of claim 1, wherein facilitating placement of a wager by each of the one or more participating players comprises facilitating placement of a wager in an amount corresponding to one or more predetermined multiples of the initial commission.

6. The method of claim 1, further comprising providing a bonus payout to each player winning with a predetermined poker rank.

7. The method of claim 1, further comprising providing a bonus payout to each player losing to the dealer while having a predetermined poker rank.

8. The method of claim 1, further comprising the dealer collecting the wagers of any of the one or more players whose resulting hand has a lower poker rank than the resulting hand of the dealer.

9. A method for playing a hold'em poker game comprising:

requiring a player to submit an initial commission for participation in a hold'em poker hand;

providing respective starting hands to the player and to a dealer;

enabling the player to place at least one bet;

if the player places the bet, requiring the dealer to call the bet;

dealing a plurality of community cards, at least some of which to be used by both the player and the dealer in creating respective resulting hands;

comparing the player's resulting hand to the dealer's resulting hand to determine an outcome of the hold'em poker hand between the player and the dealer; and the dealer collecting the initial commission submitted by the player regardless of the outcome of the hold'em poker hand.

10. The method of claim 9, wherein enabling the player to place at least one bet comprises enabling the player to place the at least one bet in an amount not greater than a predetermined multiple of the initial commission.

11. The method of claim 9, enabling the player to either fold or to place the at least one bet, and further comprising collecting the initial commission submitted by the player regardless of whether player folds or places the at least one bet.

12. The method of claim 9, further comprising a plurality of the players, wherein:

requiring a player to submit an initial commission comprises requiring each of the plurality of players to submit the initial commission for participation in the hold'em poker hand;

providing respective starting hands comprises providing the starting hands to each of the plurality of players and to the dealer;

enabling the player to place at least one bet comprises enabling each of the plurality of players to place at least one bet;

requiring the dealer to call the bet comprises requiring the dealer to call the bets placed by any of the plurality of players;

dealing the plurality of community cards comprises dealing the plurality of community cards for use by the dealer and the plurality of players who have not folded to create respective resulting hands;

comparing the player's resulting hand to the dealer's resulting hand comprises comparing each of the player's resulting hands to the dealer's resulting hand to determine an outcome of the hold'em poker hand between each of the plurality of the players relative to the dealer; and the dealer collecting the initial commission comprises the dealer collecting the initial commission submitted by each of the plurality of players regardless of the outcome of the hold'em poker hand.

13. The method of claim 9, further comprising providing a payout to the player based on the at least one bet placed by the player, if the player's resulting hand beats the dealer's resulting hand.

14. The method of claim 9, wherein providing respective starting hands comprises providing a two-card starting hands to the player and to the dealer.

15. The method of claim 9, wherein dealing a plurality of community cards comprises dealing five community cards.

16. A method for playing a hold'em poker game comprising:

requiring a player to submit an initial commission for participation in a hold'em poker hand;

providing respective starting hands to the player and to a dealer;

enabling the player to fold or place at least one bet;

if the player places the bet, requiring the dealer to call the bet;

dealing a plurality of community cards, at least some of which to be used by both the player and the dealer in creating respective resulting hands;

comparing the player's resulting hand to the dealer's resulting hand to determine an outcome of the hold'em poker hand between the player and the dealer; and the dealer collecting the initial commission submitted by the player if the player folds or loses the bet.

* * * * *

UNITED STATES PATENT AND TRADEMARK OFFICE

CERTIFICATE OF CORRECTION

PATENT NO. : 7,438,293 B2
APPLICATION NO. : 11/135804
DATED : October 21, 2008
INVENTOR(S) : Sklansky et al.

It is certified that error appears in the above-identified patent and that said Letters Patent is hereby corrected as shown below:

Title Page, Item (56) References Cited, U.S. Patent Documents:

Page 2: "2005/0167924 A1 8/2006 Sklanksy et al." should read --2005/0167924 A1 8/2006 Sklansky et al.--.

Signed and Sealed this

Twentieth Day of January, 2009

JON W. DUDAS
*Director of the United States Patent and Trademark Office*